US009659553B1

(12) United States Patent
Lawrence

(10) Patent No.: US 9,659,553 B1
(45) Date of Patent: May 23, 2017

(54) GUITAR EFFECTS PEDAL CASE

(71) Applicant: Eddie Lawrence, Colorado Springs, CO (US)

(72) Inventor: Eddie Lawrence, Colorado Springs, CO (US)

(73) Assignee: Pedaler's Chest, Inc., Colorado Springs, CO (US)

( * ) Notice: Subject to any disclaimer, the term of this patent is extended or adjusted under 35 U.S.C. 154(b) by 0 days.

(21) Appl. No.: 15/195,865

(22) Filed: Jun. 28, 2016

(51) Int. Cl.
*G10H 1/34* (2006.01)
*G10G 5/00* (2006.01)

(52) U.S. Cl.
CPC ..... *G10H 1/348* (2013.01); *G10G 5/00* (2013.01); *G10H 2210/155* (2013.01)

(58) Field of Classification Search
CPC G10G 5/005; G10G 5/00; G10G 7/00; G10G 7/005; G10D 3/00; G10D 13/026; F16M 13/00
USPC ..... 84/453.327, 329
See application file for complete search history.

(56) References Cited

U.S. PATENT DOCUMENTS 4,445,415 A 5/1984 Izquierdo
5,396,398 A 3/1995 Gill
5,603,558 A * 2/1997 Zimmer ..... A47B 81/00 206/566
5,866,829 A 2/1999 Pecoraro
6,459,023 B1 10/2002 Chandler
6,538,185 B1 * 3/2003 Stratton ..... G10H 1/348 84/422.1
6,723,909 B1 4/2004 Hooper, II
8,138,406 B2 3/2012 Vinciguerra
8,614,385 B2 12/2013 Mckinney et al.

* cited by examiner

*Primary Examiner* — Kimberly Lockett
(74) *Attorney, Agent, or Firm* — BL Speer & Associates; Brenda L. Speer

(57) ABSTRACT

The case of the present invention allows a user to store, transport and use as many as 15 guitar effects pedals, depending on size, and optional, associated accessory components such as a pedal switch controller, a power supply and a power strip, in a small footprint and enables the user to quickly and efficiently set up and play guitar with effects pedals on a plug-and-play basis. The case has a base with a shelf that can accommodate up to six effects pedals. The base also may receive and house a removable or slide-out drawer that can accommodate up to nine pedals. The drawer may have an optional, removable, upper shelf that can accommodate up to five pedals. The drawer may have an optional, articulating shelf that can accommodate mounted thereon a pedal switch controller for the pedals and at least one pedal.

9 Claims, 7 Drawing Sheets

GUITAR EFFECTS PEDAL CASE

BACKGROUND OF THE INVENTION

Field of the Invention

The field of the present invention relates to a case for storage, transport and use of electric guitar effects pedals.

Description of Related Art Including Information Disclosed Under 37 CFR 1.97 and 37 CFR 1.98

Effects pedals are used by musicians in conjunction with electric guitars to create various desired effects to the guitar's sound when played. Categories of effects pedals are distortion, wah or wah-wah, reverb, delay, chorus, flanger, phaser, compressor, fuzz, looping, boost, sitar, organ, echo, multi-effects and so on. Many guitarists also use an equalizer pedal to further shape and customize their sound. As a result, even an amateur guitarist has numerous effects pedals that he or she commonly uses to play guitar and which numerous pedals must be transported from gig to gig. Current storage, transportation, set up and use options for guitar effects pedals are few and lacking in various ways.

For example, an option is a board that holds pedals and the board is placed in a separate case or gear bag or for transportation. However, with this option, the pedals and pedal cords are exposed and vulnerable to damage and the pedals are susceptible to becoming unhooked in the case or bag. Also, the pedals and pedal cords have to be disconnected, unplugged and put into the case or bag before transportation. Likewise, prior to performance, the pedals and pedal cords have to be connected, plugged in and set up. Both of these gig tear-down and set-up exercises are a time sink and inconvenient.

U.S. Pat. No. 4,445,415 issued May 1, 1984, by Izquierdo for "Portable Case and Stand for Pedal Controls Operationally Fixed Therein for Use with a Keyboard Temporarily Mountable Thereon" discloses a box with a removable top and a hingable side part for closing into a case to store and carry effects control pedals and miscellaneous gear of a keyboard stand, and opening into a stand for supporting a keyboard in playing position relative to operationally fixed and connected pedals and gear.

U.S. Pat. No. 5,396,398 issued Mar. 7, 1995, by Gill for "Portable Control Console" discloses an audio mixer console and a power amplifier that are mounted in a self-contained carrying case that provides both protection for the console and amplifier during transportation and storage and a support during use. A power amplifier is fixedly connected between lower portions of first and second spaced sides at the upper end of which is pivoted a front section of the mixer console. In stored position the mixer console extends downwardly between the sides to a position adjacent the amplifier, and a detachable cover is secured to the sides to extend over both the mixer console and amplifier. Parts of the mixer console and amplifier form at least portions of a forward cover of the completed carrying case. For use of the mixer console and amplifier the detachable cover is detached, the mixer console is pivoted upwardly and rearwardly, and the detached cover is inserted between the case sides at an acute angle to the sides, to provide an "X" shaped support configuration, so that an upper part of the cover supports the outwardly and rearwardly extending rear section of the mixer console and a bottom part of the cover contacts the ground to cooperate with the lower portions of the sides to form an extended support base for the assembly.

U.S. Pat. No. 5,866,829 issued Feb. 2, 1999, by Pecoraro for "Pedal Rack" discloses a pedal rack comprising a case with a plurality of a variety of electronic components that may be electrically connected together and retained within the case. A sound control unit may be electrically connected to the electronic components. A facility is for pivotally mounting the sound control unit within the case. The sound control unit can go between a generally horizontal storage position "A" over the electronic components and into an upright operational position "B" for easy access. The sound control unit may also be completely removed from the case.

U.S. Pat. No. 6,459,023 issued Oct. 1, 2002, by Chandler for "Mounting Board for Guitar Effects" discloses an effect support board including an effect mounting surface adapted to mount a guitar effect and including a cable connection opening adapted to allow the cable to pass from beneath the effect mounting surface for connection to the guitar effect on top of the effect mounting surface. The effect mounting surface is supported by a frame.

U.S. Pat. No. 6,723,909 issued Apr. 20, 2004, by Hooper, II, for "Gig Box" discloses a system for simplifying the transport, set-up and use of electrically amplified musical instruments such as guitars and electric bases. It is comprised of a combination of components that are normally carried and set-up separately by the performer and thereby saves the performer considerable time and effort in transport and set-up of his equipment. Included in the invention are an integrated accessory case, guitar stand and pedal effects board. Additional features provide the special protection required for effects pedals during transport.

U.S. Pat. No. 8,138,406 issued Mar. 20, 2012, by Vinciguerra for "Extension for Guitar Effects Pedal Board" discloses a pedal board extension that provides a pedal board with a platform for additional effects and/or over-sized effects. One or more U-shaped members are arranged along one edge of the extension. When the extension is mated to the pedal board, the U-shaped members engage with an end rail of the pedal board, thus securely joining the extension to the pedal board.

U.S. Pat. No. 8,614,385 issued Dec. 24, 2013 by McKinney et al., for "Musical Effects Pedal Retaining Device and Pedal Board" discloses a pedal board that has an attachment mechanism, mounting member, and musical effects pedal retaining device. The attachment mechanism is carried by the musical effects pedal retaining device and functions to attach a musical effects pedal to the musical effects pedal retaining device. At least a portion of the musical effects pedal retaining device is releasably attachable to the mounting member to function to assist making the musical effects pedal releasably attachable to the mounting member. At least a portion of the musical effects pedal retaining device is releasably attachable to the mounting member through a mechanical engagement that is not a hook and loop type fastener.

BRIEF SUMMARY OF THE INVENTION

The present invention discloses and claims a guitar effects pedal case comprising a lid, a base and a removable drawer. In a preferred embodiment, the lid encloses and is removably attachable to the base, wherein the base has three sides, a bottom and a base shelf with at least a base shelf passage therein, and which sides, bottom and shelf form a base cavity to receive the drawer. The drawer is removable from the base cavity and has an optional, removable upper shelf with at least an upper shelf passage therein, and further wherein the upper shelf has an upper shelf front with at least an upper shelf front passage therein, and which upper shelf forms a drawer cavity when the upper shelf is removably inserted in the drawer. Optionally, the drawer has an articulating shelf and the articulating shelf forms a fourth side of the base when the drawer is received in the base cavity and the articulating shelf is in a closed position.

LIST OF REFERENCE NUMERALS

Figure 1:
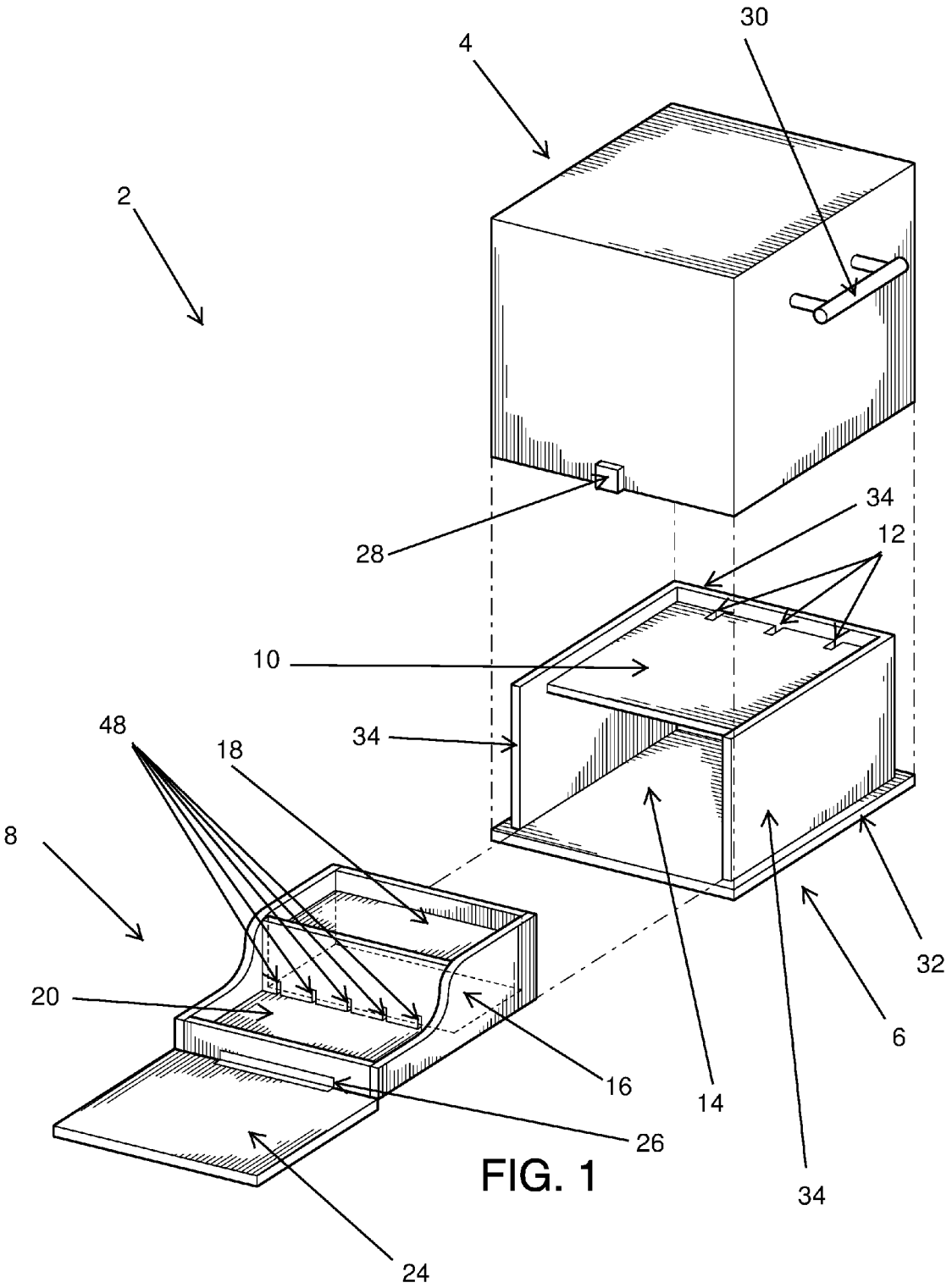
FIG. 1 is an exploded, perspective view of a guitar effects pedal case of the present invention.

2 case
4 lid
6 base
8 drawer
10 base shelf
12 base shelf passages
14 base cavity
16 drawer cavity
18 drawer upper shelf
20 drawer lower shelf
22 drawer upper shelf passages
24 articulating shelf
26 hinge
28 latch
30 handle
32 base bottom
34 base sides
36 controller
38 power supply
40 power strip
42 pedals
44 drawer upper shelf support
46 drawer upper shelf front
48 drawer upper shelf front passages

DETAILED DESCRIPTION OF THE INVENTION

A guitar effects pedal case of the present invention solves a guitar musician's or user's problem of storing, transporting and setting up guitar effects pedals. With the case of the present invention, a user does not have to disconnect, unplug and pack up the pedals and pedal cords into a case or bag after playing and before transportation; nor, likewise, prior to performance, does the user have to unpack, connect, plug in, set up and reconfigure play settings of the effects pedals and pedal cords prior to playing, thus saving the user time and inconvenience. Additionally, with the case of the present invention, the pedals and pedal cords are not exposed and vulnerable to damage and are not susceptible to becoming unhooked, nor are the play settings likely to be disturbed or become unconfigured in a case or bag during storage and transportation.

The case of the present invention is capable to house or hold guitar effect pedals for use at home, in the practice place, or on the road. The case provides a musician or user a case that can safely store and transport the musician's effects pedals in a hard case that will in turn, open up and enable the user to be able to plug and play an electric guitar with associated effects pedals with minimal set up effort.

The innovative design of the case of the present invention allows a musician or user to hold more guitar effects pedals in a smaller foot print and to store, transport and use guitar effects pedals. In a preferred embodiment, the case of the present invention has a base with a shelf that can accommodate from about three to about six effects pedals, depending on the size of the pedals. The base also may receive and house a removable or slide-out drawer and the drawer can accommodate from about six to about nine effects pedals, depending on the size of the pedals. The drawer may also optionally have a removable, upper shelf and the upper shelf can accommodate from about four to about five effects pedals, again, depending on the size of the pedals. The drawer may have an optional articulating shelf which may fold down or be lowered to an open configuration and the articulating shelf can accommodate up to an eight-switch pedal controller mounted thereon, as well as what is commonly referred to as a mini-wah effects pedal. The case of the present invention can accommodate as many as 15 effects pedals and optional, associated accessory components such as a pedal switch controller, a power supply and a power strip. A power supply integrated into the case enables a user to quickly and efficiently set up and play guitar with effects pedals on a plug-and-play basis. The case may have an optional master switch to turn on power to al components in the case at once.

Figure 6:
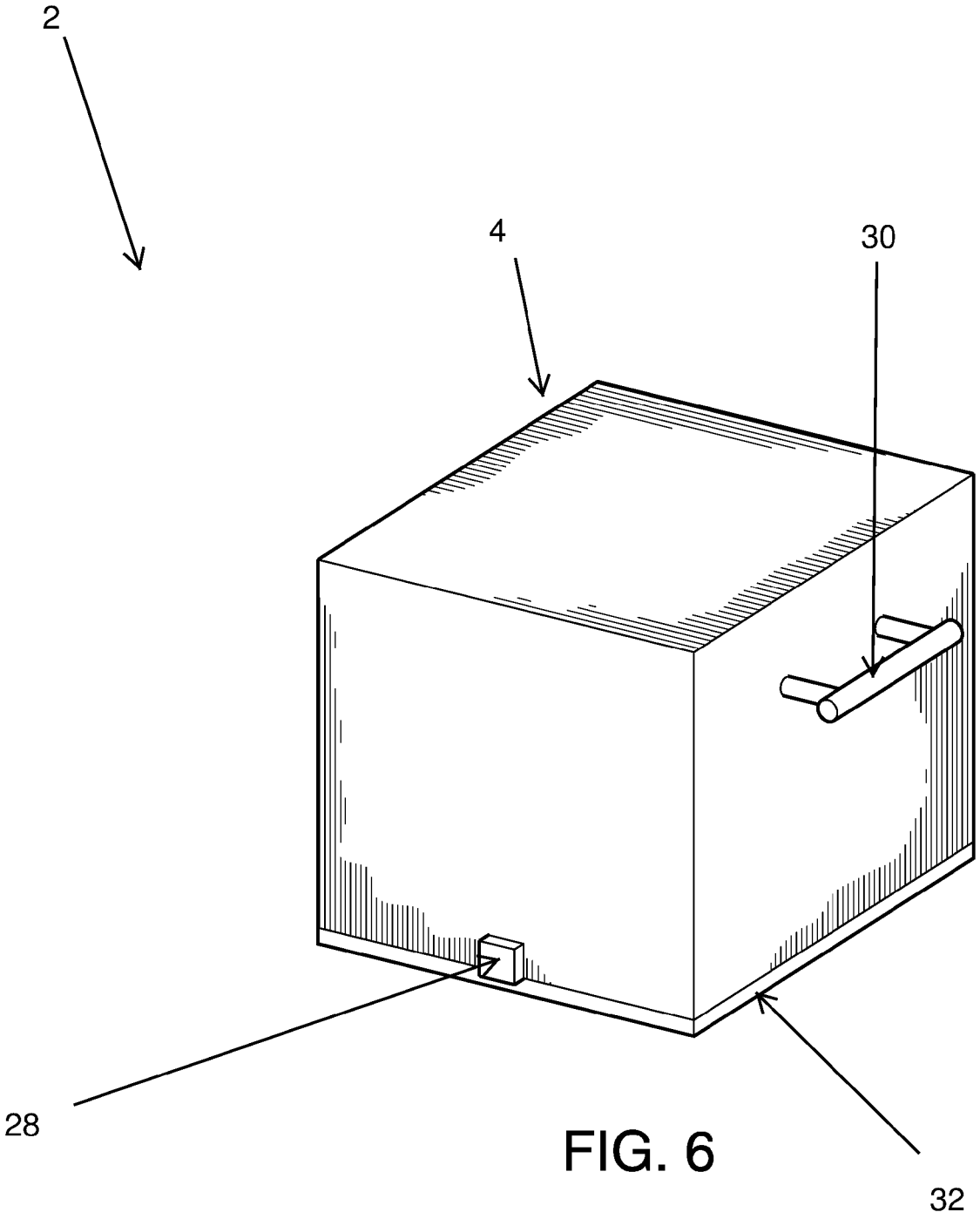
FIG. 6 is a perspective view of the guitar effects pedal case of the present invention in a closed configuration.

With reference to FIG. 6, the case 2 of the present invention may be constructed with any suitable dimensions and with any suitable material which is durable and sturdy, such as wood, metal, plastic and the like or any combination thereof. In an embodiment of the present invention, the case 2 in a closed configuration is about 25" in width, by about 14" in length, and by about 8" in height. A lid 4 of the case 2 may optionally have a handle or handles 30 to allow the case 2 to be picked up and carried easily when the case 2 is in a closed configuration. Any suitable closure mechanism, such as a latch 28, may be used to removably attach or secure the lid 4 to a base bottom 32 of the base 6. Also, the lid 4 of the case 2 completely covers and encloses the base 6.

Figure 2:
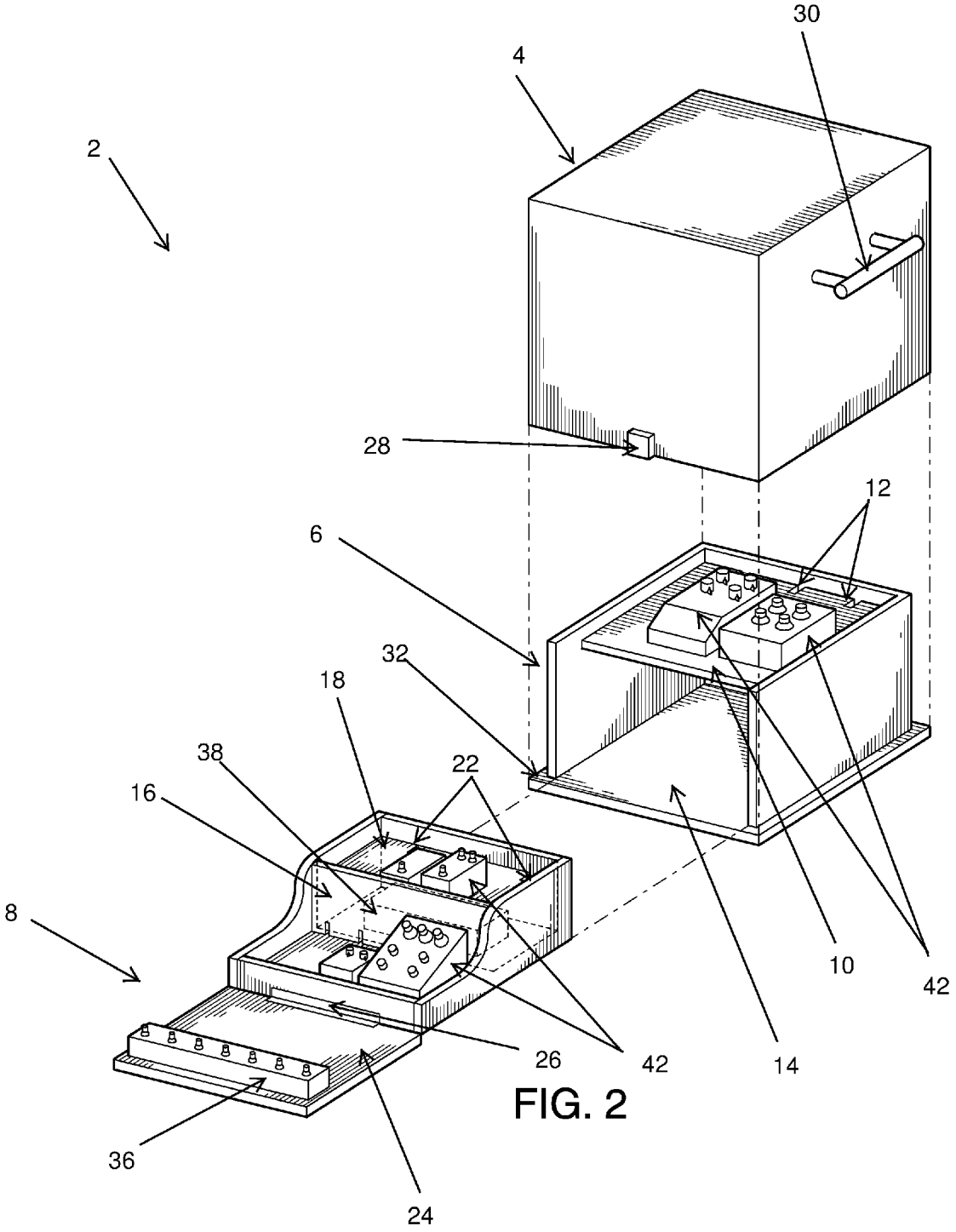
FIG. 2 is another exploded, perspective view of the guitar effects pedal case of the present invention depicting at least a guitar effects pedal or related component therein.
Figure 7:
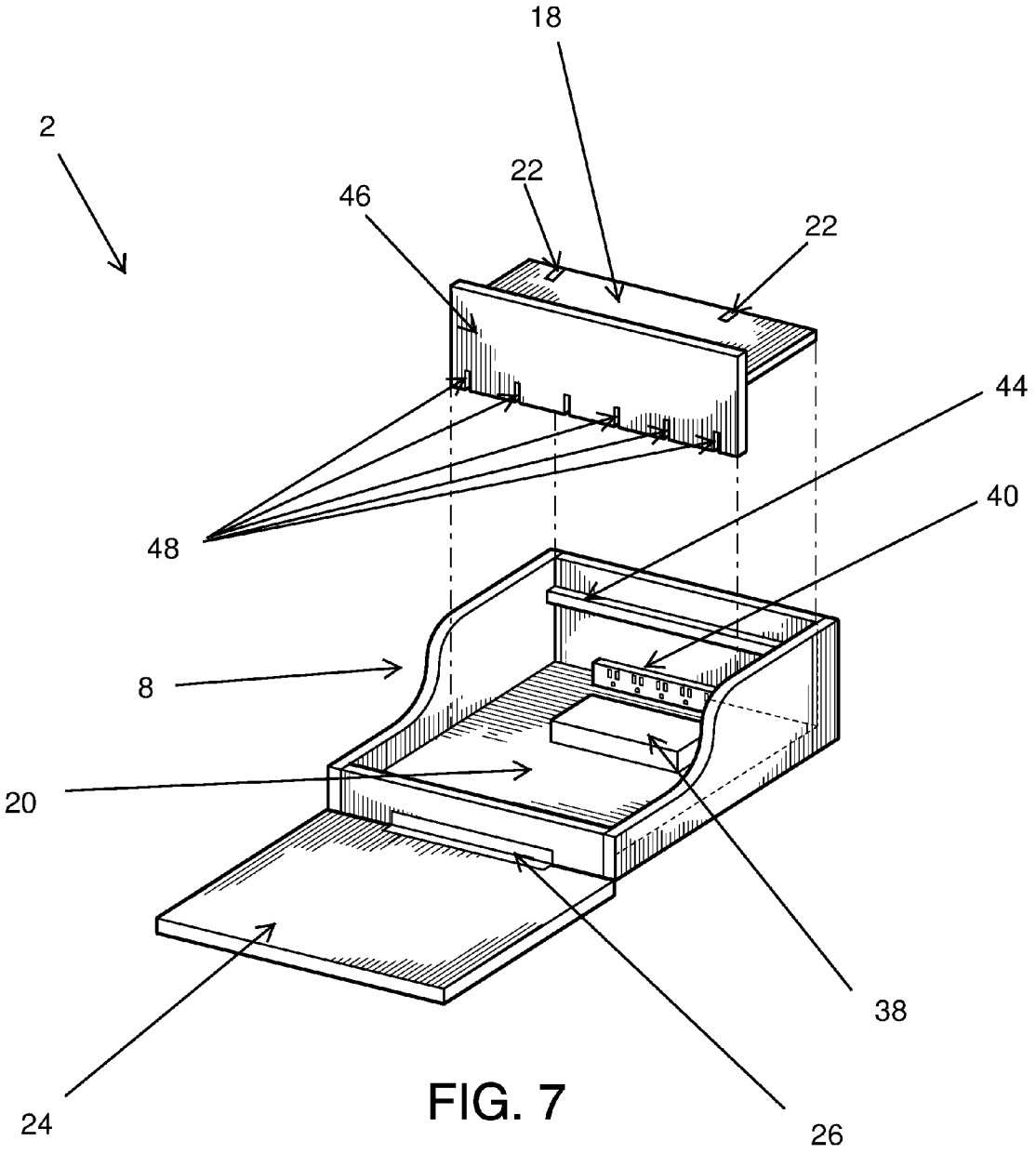
FIG. 7 is an exploded, perspective view of a drawer of the guitar effects pedal case of the present invention depicting at least a guitar pedal or related component therein.

With reference to FIG. 1, FIG. 2 and FIG. 7, a drawer 8 of the case 2 may be from about 24" in width to about 12.5" in length (with an optional articulating shelf 24 in an upright or closed configuration) and to about 2.5" in height at its front end and to about 4.5" in height at its back end. The drawer 8 has a drawer lower shelf 20 which is integral with and the same as a bottom of the drawer 8. The drawer lower shelf 20 can accommodate from about 3 to about 9 effects pedals or other components as noted herein.

The drawer 8 may have an optional removable drawer upper shelf 18 and which upper shelf 18 may be from about 24" in width by about 6.75" in length by about 2" in height (a clearance height of the upper shelf 18 above a bottom of the drawer 8). To support the removable drawer upper shelf 18 when the drawer upper shelf 18 is removably inserted within the drawer 8, the drawer upper shelf 18 has a drawer upper shelf front 46 that rests upon a bottom of the drawer 8 and the drawer 8 has a drawer upper shelf support 44 upon which the upper shelf 18 rests. The drawer upper shelf front 48 preferably may have at least a drawer upper shelf front passage 48 therein which drawer upper shelf front passages 48 can accommodate power cords and cables of pedals 42 in the drawer 8 and connect the pedals 42 to a power supply 38 and power strip 40 of the case 2. The drawer upper shelf front passages 48 allow the cords and cables from pedals and components on the drawer lower shelf 20 to be fed through the passages 48 and into a drawer cavity 16 to keep the cords and cables out of sight and secure.

With reference to FIG. 1, FIG. 2, FIG. 3 and FIG. 7, a drawer cavity 16 is formed when the removable drawer upper shelf 18 is placed within the drawer 8. The drawer cavity 16 can accommodate an optional power supply 38 and an optional power strip 40 to which the pedals 42 may be connected, and can accommodate the associated cords and cables of the power supply 38, power strip 40 and pedals 42 to be run underneath the drawer upper shelf 18 and into the drawer cavity 16. For this purpose, the drawer upper shelf 18 has at least a drawer upper shelf passage 22 therein, and the upper drawer shelf front 48 has at least a drawer upper shelf front passage 48 therein, which passages 22, 48 can accommodate power cords and cables of pedals 42 in the drawer 8 and connect the pedals 42 to a power supply 38 and power strip 40 of the case 2.

Figure 5:
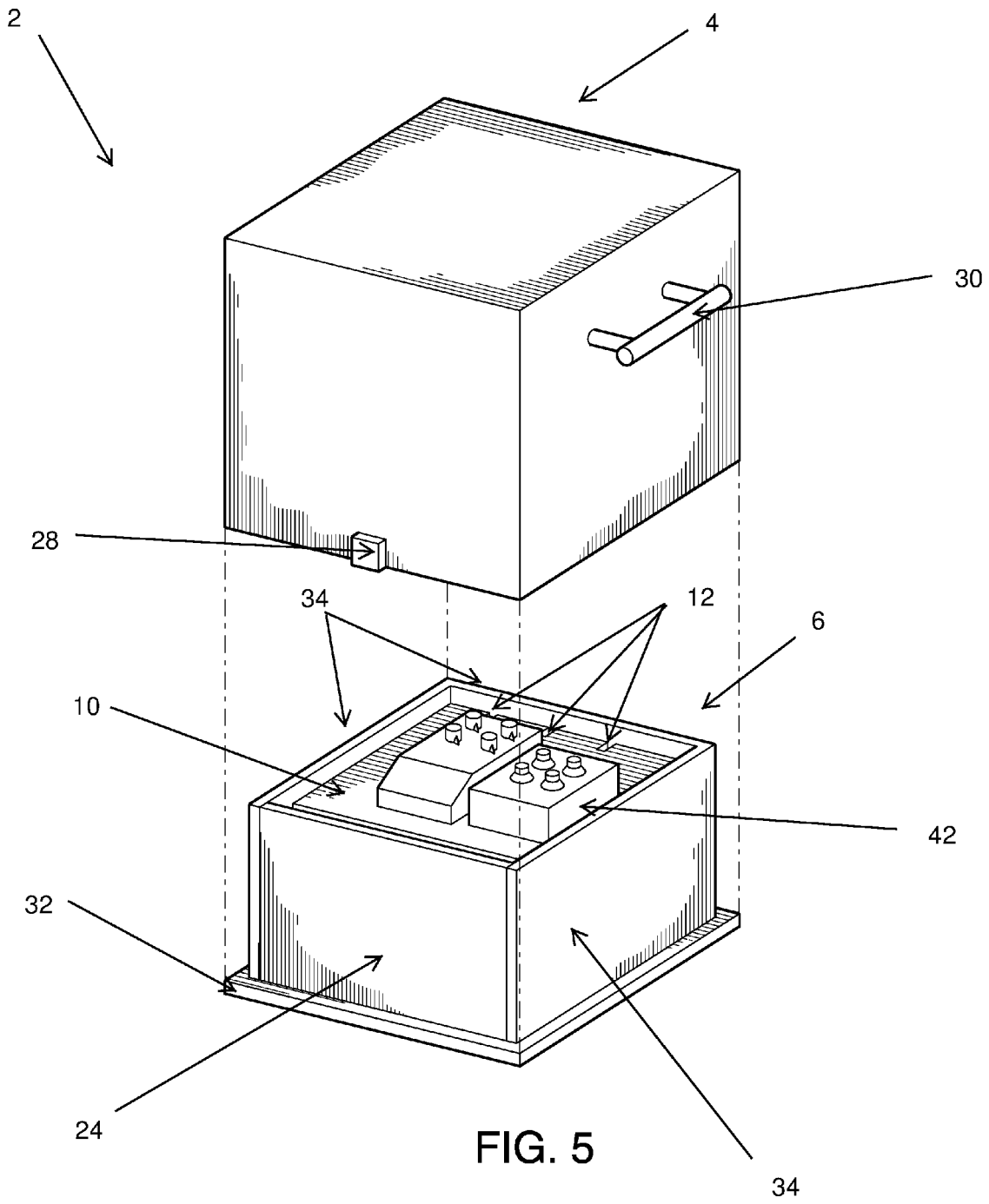
FIG. 5 is another partially exploded, perspective view of the guitar effects pedal case of the present invention depicting at least a guitar effects pedal or related component therein; wherein a drawer of the case is fully inserted into a base of the case and an articulating shelf is in a closed position.

With reference to FIG. 1, FIG. 2, FIG. 3, FIG. 4, FIG. 5 and FIG. 7, the drawer 8 may have an optional articulating shelf 24 which articulates from a closed configuration (articulating shelf 24 in an upright position as shown in FIG. 5) to an open configuration (articulating shelf 24 in a downward position as shown in FIG. 1, FIG. 2, FIG. 3, FIG. 4 and FIG. 7) by any suitable means, such as a hinge 26. The hinge 26 is preferably a piano hinge, which hinge 26 is mounted on the inside of articulating shelf 24 so that the hinge 26 is not visible when the articulating shelf 24 is in an upright or raised position, or closed configuration. The articulating shelf 24 can accommodate a controller 36 mounted thereon which controller 36 is used to operate pedals 42.

The removable drawer 8 may be removably containable or insertable into the base cavity 14. To stow or removably contain or insert drawer 8 in base cavity 14 of the base 6, the drawer 8 is slid into or placed within the base cavity 14 of base 6. The optional articulating shelf 24 is raised to an upright configuration as shown in FIG. 5 and secured to the base 6 by any suitable means, such as a butterfly latch that may be placed on each of a left side and a right side of the articulating shelf 24 and which butterfly latch secures the articulating shelf 24 in an upright position or closed configuration to the base 6. The lid 4 may then be secured to the base bottom 32 of base 6 by means of a base latch 28, which base latch 28 may be any suitable latching mechanism. The case 2 of the present invention is then in a closed configuration with all pedals 42, controller 36, power supply 38 and power strip 40 safely and securely stored therein and ready for transport. When the case 2 is in a closed configuration, pedals 42 are protected while not in use and resetting of any knobs of the pedals 42 is prevented.

Figure 3:
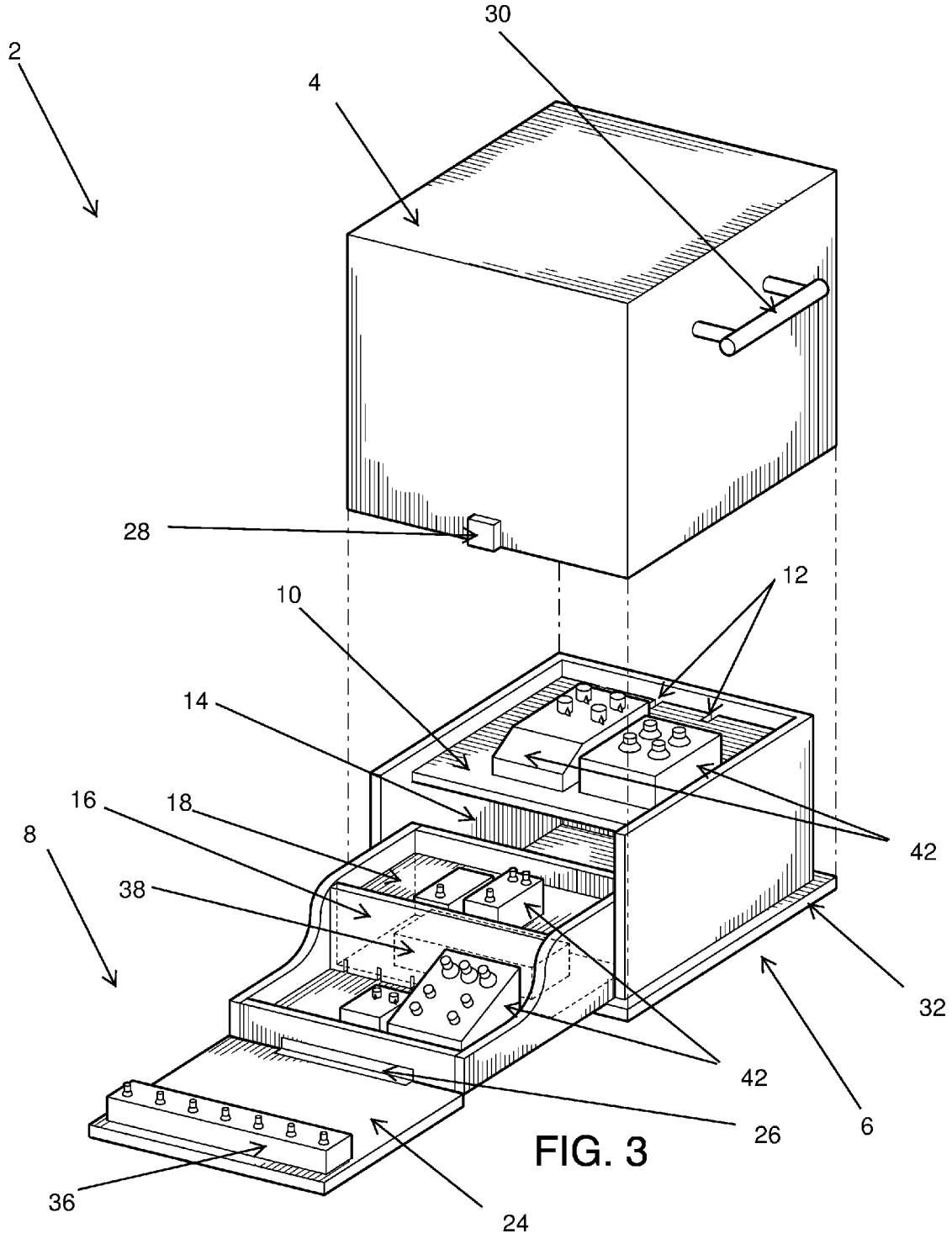
FIG. 3 is another partially exploded, perspective view of the guitar effects pedal case of the present invention depicting at least a guitar effects pedal or related component therein; wherein a drawer of the case is partially inserted into a base of the case.
Figure 4:
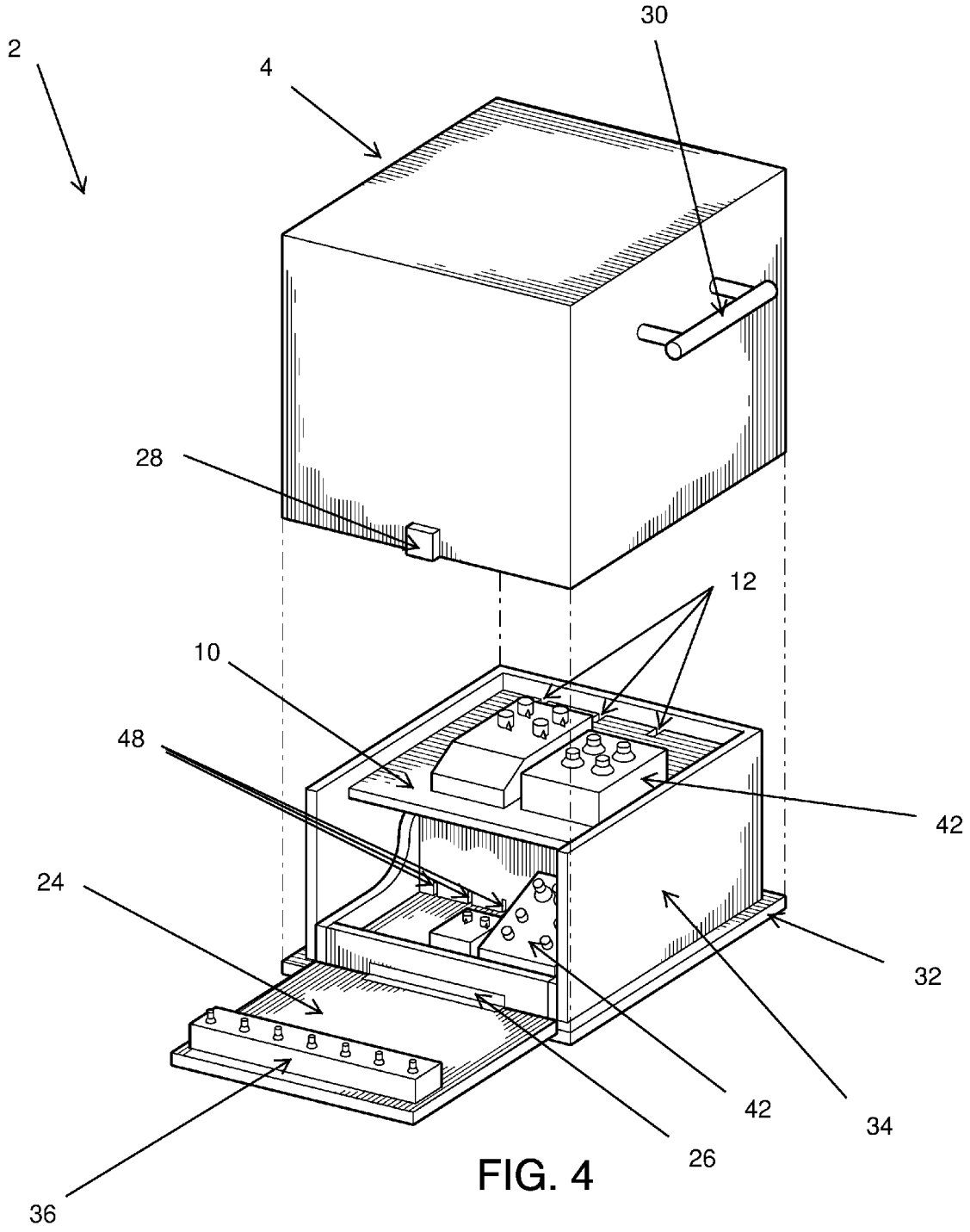
FIG. 4 is another partially exploded, perspective view of the guitar effects pedal case of the present invention depicting at least a guitar effects pedal or related component therein; wherein a drawer of the case is fully inserted into a base of the case.

When the case 2 is in use by a musician or user, the id 4 is removed and the drawer 8 may be slid out or removed from the base 6 as shown in FIG. 3. The lid 4 may be placed behind or next to drawer 8 and a top surface of the lid 4 may serve as additional surface area to accommodate additional pedals 42 or other components or accessories of the user, such as a loop recorder. The optional articulating shelf 24 may be lowered into an open configuration. The articulating shelf 24 is from about 25" in width to about 6" in length (when lowered or open) or height (when raised or closed). With the articulating shelf 24 in an open configuration, a footprint of the drawer 8 is from about 25" in width to about 28" in length.

With reference to FIG. 6, in a closed configuration, a preferred embodiment of the case 2 of the present invention has dimensions of about 25" in width by about 14" in length by about 8" in height. With reference to FIG. 1, the base 6 of the case 2 has a base shelf 10 and base cavity 14. The base shelf 10 can accommodate from about two to about six pedals 42 depending on their size. The base cavity 14 can accommodate the removable, slide-out drawer 8. The drawer 8 has an upper shelf 18, a lower shelf 20 and an articulating shelf 24 that can be configured to fold down into an open position or to fold up into a closed position by any suitable means, such as a hinge 26.

With reference to FIG. 5, the articulating shelf 24, when folded up into a closed position and the drawer 8 is placed within the base cavity 14 of the base 6, forms a wall or side of base 6 of the case 2. The base 6 has three other walls or sides 34 which are fixed and integral with the base 6. With reference to FIG. 2 and FIG. 3, the articulating shelf 24 can accommodate a switch pedal effects controller 36 that is used to power on and operate various components and pedals 42, as well as a small pedal 42, such as a mini-wah pedal.

With reference to FIG. 1 through FIG. 5, the base 6 has a base shelf 10 which has at least a base shelf passage 12 therein. The base shelf passages 12 allow the cords and cables from pedals 42 and components on the base shelf 10 to be fed through the passages 12 and into a drawer cavity 16 to keep the cords and cables out of sight and secure.

As stated, the case 2 can accommodate an optional power supply 38, such as within the drawer cavity 16. In an alternative embodiment not shown, the optional power supply 38 may be mounted on a rear or back base side 34 of base 6, either flush-mounted thereon or mounted within a recessed area. Mounting the power supply 38 on the back base side 34 increases the capacity of the case 2 to contain more pedals 42, such as within the drawer cavity 16. In this alternative embodiment, the recess may be about 0.75" in depth to accommodate a power supply 38 to be vertically mounted therein. Additionally, an optional cover can be attached to the back of the case 2 as a flush fit and to cover the optional recess and power supply 38, which cover may be from about 25" in width by about 6" in height by about 2" in depth.

Numerous aesthetic variations or artistic themes are available to decorate or adorn the case 2 and provide the case 2 artistic form with innovative functionality. Among the aesthetic variations styled or envisioned by the inventor include, but are not limited to: (a) Mad Scientist: a mad scientist's lab inspired by steampunk and fashioned after the lab of Victor Lordcraft; (b) Gentleman's Chest: a finished piece of furniture for the home with a stained wood furniture finish; (c) Road Warrior: for touring and playing out with an apocalyptic design that would be the envy of Mad Max; (d) Wizard's Grimoire: a smaller box for multi-use with the look of a magician's box that would conjure the great Merlin himself; (e) Witch's Caldron: a box of spells and magical trinkets; and (f) Vanity: a box of sparkling bling and beauty. These aesthetic variations would be optional components of the case of the present invention.

Although the present invention has been described with reference to specific embodiments, it is understood that modifications and variations of the present invention are possible without departing from the scope of the invention, which is defined by the claims set forth below.

Unless defined otherwise, all technical and scientific terms used herein have the same meaning as commonly understood by one of ordinary skill in the art to which this invention belongs. Although any methods and materials similar or equivalent to those described herein can also be used in the practice or testing of the present invention, the preferred methods and materials are herein described.

The invention claimed is:

1. A guitar effects pedal case comprising:

a. A lid, wherein the lid encloses and is removably attachable to a base;

b. A base, wherein the base has three sides and a bottom which form a base cavity to receive a drawer;

c. A drawer, wherein the drawer is removable from the base cavity and the drawer has an articulating shelf; and d. An articulating shelf, wherein the articulating shelf forms a fourth side of the base when the drawer is received in the base cavity and the articulating shelf is in a closed position.

2. The guitar effects pedal case of claim 1, further wherein the base has a base shelf above the base cavity.

3. The guitar effects pedal case of claim 2, further wherein the base shelf has at least a base shelf passage therein.

4. The guitar effects pedal case of claim 1, further wherein the drawer has a removable upper shelf.

5. The guitar effects pedal case of claim 4, further wherein the upper shelf has at least an upper shelf passage therein.

6. The guitar effects pedal case of claim 4, further wherein the upper shelf has an upper shelf front.

7. The guitar effects pedal case of claim 6, further wherein the upper shelf front has at least an upper shelf front passage therein.

8. The guitar effects pedal case of claim 4, further wherein the upper shelf forms a drawer cavity when the upper shelf is in the drawer.

9. A guitar effects pedal case comprising:

a. A lid, wherein the lid encloses and is removably attachable to a base;

b. A base, wherein the base has three sides, a bottom and a base shelf with at least a base shelf passage therein, and which sides, bottom and shelf form a base cavity to receive a drawer; and c. A drawer, wherein the drawer is removable from the base cavity and has a removable upper shelf with at least an upper shelf passage therein, and further wherein the upper shelf has an upper shelf front with at least an upper shelf front passage therein, and which upper shelf forms a drawer cavity when the upper shelf is in the drawer;

further wherein the drawer has an articulating shelf and the articulating shelf forms a fourth side of the base when the drawer is received in the base cavity and the articulating shelf is in a closed position.

* * * * *